US005375729A

United States Patent [19]

Schubert

[11] Patent Number: 5,375,729

[45] Date of Patent: Dec. 27, 1994

[54] EASY-OPEN CONTAINER END

[75] Inventor: James R. Schubert, Dayton, Ohio

[73] Assignee: Dayton Reliable Tool & Mfg. Co., Dayton, Ohio

[21] Appl. No.: 50,837

[22] Filed: Apr. 21, 1993

[51] Int. Cl.[5] ..... B65D 17/34

[52] U.S. Cl. ..... 220/271; 220/269; 413/16

[58] Field of Search ..... 220/269, 270, 271, 272, 220/273; 413/8, 12, 15, 16, 17

[56] References Cited

U.S. PATENT DOCUMENTS

| | | | |
|---|---|---|---|
| 4,015,744 | 4/1977 | Brown | 220/269 |
| 4,024,981 | 5/1977 | Brown | 220/269 |
| 4,030,631 | 6/1977 | Brown | 220/269 |
| 4,084,721 | 4/1978 | Perry | 220/269 |
| 4,348,464 | 9/1982 | Khoury | 428/571 |
| 4,503,989 | 3/1985 | Brown et al. | 220/269 |
| 4,946,063 | 8/1970 | Heyes et al. | 220/270 |
| 5,129,541 | 7/1992 | Voight et al. | 220/269 |

OTHER PUBLICATIONS

Dayton Reliable Tool & Mfg. Co.; Technical Information for Triple T System; Mar. 1990.

*Primary Examiner*—Allan N. Shoap
*Assistant Examiner*—Nova Stucker
*Attorney, Agent, or Firm*—Joseph G. Nauman

[57] ABSTRACT

The invention, relating to an easy-open metal container end, places a portion of the metal of the tear panel, in the region where a score stop otherwise would be located, under compression by forming a short coined depression or bead in the tear panel, preferably in the public side, close to the score line at least at the end of the vent region opposite from the inner hook, which is located at the radially inward end of the tear panel score line. During initial opening or venting action, as the rivet is lifted by initial tab motion, separation proceeds along the score line, beneath the nose of the tab. The metal adjacent and in this coined depression tends to move partially underneath the metal on the opposite side of the score line from the coined vent bead. This action provides sufficient disruption or retarding of the score line separation or rupture, during venting, to confine such separation to the vent region until internal pressure is vented. Further separation of the tear panel can proceed under control of continued raising tab motion and resulting opening force. By providing such a coined vent bead, the score stop may be made considerable less deep leaving adequate residual metal along score line 15, or the score stop can be entirely eliminated in some cases, thereby making it possible to achieve consistent and proper venting in ends made of thinner metals, e.g. in the order of 0.009–0.008 inch.

6 Claims, 4 Drawing Sheets

EASY-OPEN CONTAINER END

This invention relates to easy-open ends for containers, and particularly for beverage cans and the like which are internally pressurized. Specifically, the invention relates to an improved construction for venting or releasing the pressure internal of the container during the initial operation of the easy-open mechanism of the end, particularly such a construction which is applicable to ends made of thinner metal material.

BACKGROUND OF THE INVENTION

The mechanism of venting in an easy-open container end is per se known, for example as described in U.S. Pat. No. 4,015,744 of Apr. 5, 1977 and U.S. Pat. No. 4,030,631 of Jun. 21, 1977 which are assigned to the assignee of this application. The easy-open mechanism includes an end panel which is attached to the container, a tear panel defined in the end panel by a score line, an operating tab including a nose which extends partially over the tear panel, and an integral rivet connecting the tab to the end panel and defining a pivot point for tab operation. Basically, initial lifting of the tab produces an upward force on the rivet and a downward force on an edge of the tear panel, preferably adjacent a beginning point of the tear panel score line. This in turn causes an initial opening of the tear panel beneath the nose of the tab, a limited expansion of that opening along a vent region, and then further lifting motion of the tab causes the tear panel to separate progressively along its score line, leaving a small integral connection between the end panel and tear panel, about which the tear panel is rotated inward of the container to form an opening through which container contents can be removed.

Particularly in canned carbonated beverages there is substantial internal pressure, e.g. in the order of 100 psi., in the small space between the top of the liquid contents and the product side of the can end. This pressure must vent quickly through a small vent opening in the vent region during the initial opening motion. At present it is customary to define this small vent opening with a hook formation at the radially inner end of the score line and a score stop (also called a check stop or arrestor stop) in the region where the tear panel score line proceeds outward of the end. The score stop is in the form of a shallower (less deep) segment of the score line, of relatively short length, such as described for example in U.S. Pat. No. 4,503,989 issued Mar. 12, 1985. This score stop provides an increase in tear resistance along the score line. Thus, the vent region is defined by the upper hook on one side of the tab, and the score stop on the opposite side. If the function of the score stop is not included, the releasing high pressure from the can may under some circumstances force rapid continuing separation along the score line, and literally blow the tear panel off the end with considerable force.

There has been a continuing effort (induced by desired economies in metal usage) to use thinner metal for can ends. Until recently, end stock (principally aluminum) was in the order of 0.011 inch or greater in thickness. Presently, ends are being made with metal in the order of 0.009–0.008 inch in thickness. As thinner metal is employed in making can ends, the effectiveness of the score stop has decreased. There simply is not sufficient metal in the thicker stop portion of the score line to resist effectively the continuing score line separation immediately following venting. Therefore, a need exists for another way to retard the score line separation for the initial venting or "pop" when opening of the end commences.

Related to the venting provisions, a so-called "dimple down" bead has been formed in tear panels by simply depressing a section of the tear panel, usually near the vent region of the tear panel score line, inwardly of the end. Normally no coining is performed on this prior art bead, the metal is simply displaced to define the bead, which is intended to add strength to the tear panel during opening, and which also may function when compressed during scoring to insure good integrity in the rivet area.

SUMMARY OF THE INVENTION

The present invention places a portion of the metal of the tear panel, in the region where a score stop otherwise would be located, under compression by forming a short coined depression or bead in the tear panel, preferably in the public side, close to the score line at least at the end of the vent region opposite from the inner hook, which is located at the radially inward end of the tear panel score line. During the venting action, as the rivet is lifted by the initial tab motion, separation proceeds along the score line, beneath the nose of the tab. The metal adjacent and in this coined depression tends to move partially underneath the metal on the opposite side of the score line from the coined vent bead. This action provides sufficient disruption or retarding of the score line separation, during venting, to confine such separation to the vent region until internal pressure is vented. Further separation of the tear panel can proceed under control of continued raising tab motion and resulting opening force.

By providing such a coined vent bead, the score stop (or arrestor stop) may be made considerably less thick than in prior practice, or the score stop can be entirely eliminated in some cases, thereby making it possible to achieve consistent and proper venting in ends made of thinner metals, e.g. in the order of 0.009–0.008 inch, and to provide an easily opened end.

The primary object of this invention, therefore, is to provide such a coined vent bead in an easy-open container end; to provide a method of making an end having such a feature; and thereby to provide additional economy in the construction of easy-opening ends by allowing use of thinner gage metal while retaining the integrity of the venting action which is needed in cans of carbonated beverages, in particular.

Other objects and advantages of the invention will be apparent from the following description, the accompanying drawings and the appended claims.

DESCRIPTION OF THE PREFERRED EMBODIMENT

Figure 1:
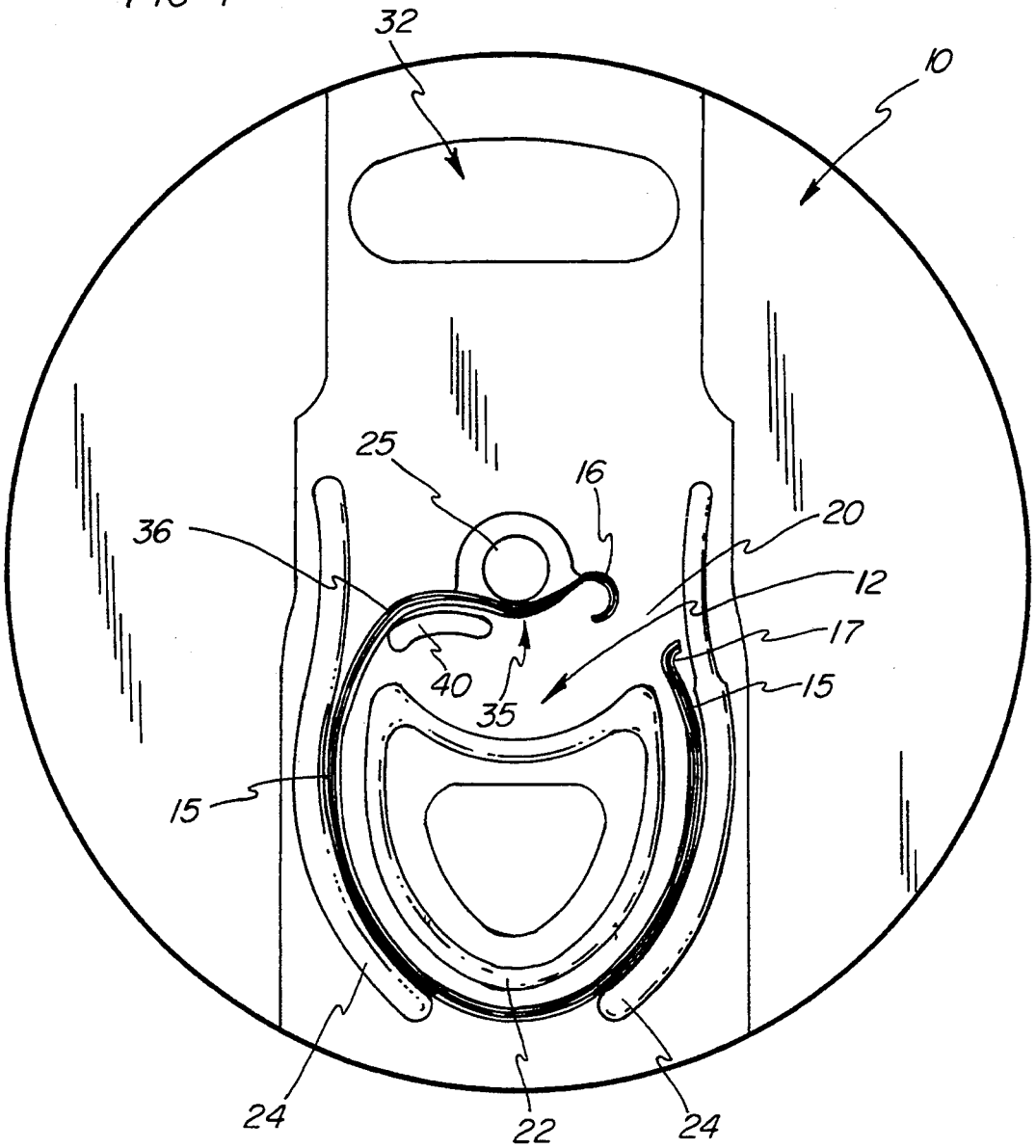
FIG. 1 is a top or public side plan view of an easy open container end incorporating the invention, with the tab shown in phantom lines.

Referring to FIG. 1, the end panel of an easy-open container end is shown at 10 and includes an integral tear panel (or pouring panel) 12 defined by a score line 15 which runs from an inner hook or end 16 across a vent region (later described) and thence in a loop around the edge of the tear panel to an outer hook 17. Between the inner and outer ends or hooks of score line 15 there remains an integral connecting region 20 which will function as a hinge and retainer of the tear panel when it is opened. An inner bead 22 is formed around tear panel 12, and outer beads 24 are formed in end panel 10 along the side of score line 15.

An integral rivet 25 connects the rivet island 26 of an operating tab 27 (shown in phantom, FIG. 2) to end panel 10, at a location adjacent the inner end or hook 16 of score line 15. The nose 28 of the tab extends across score line 15 and partially over tear panel 15, being contoured to the shape of the upper part of inner bead 22 as shown. The opposite end 30 of tab 27 extends over end panel 10, terminating at a depression 32 in the end panel which facilitates lifting of tab 27 to initiate opening operation.

When the tab is lifted, nose 28 engages tear panel 12 adjacent inner bead 22 and continued movement of the tab lifts rivet 25 to break score line 15 in the vent region 35 (mentioned above) beneath the tab nose, resulting in venting of the container and release of internal pressure. This operation, as is known, produces the original "pop" or separation of the score line 15 in the center of vent region 35, forward of rivet island 26 and progressing outward therefrom, and allows venting of pressure from within the container. The pulling force via rivet 25 acts in the same direction as the pressure force exerted internally against the underside of the end. The limits of the opening in vent region 35 are defined by inner hook 16 and the curve 36 in score line 15 from whence the score line proceeds in a loop about tear panel 12.

After the initial venting, the lifting motion of tab 27 proceeds, tear panel 12 is pushed inward of the container, hinging around the region 20 as the material now proceeds to separate along score line 15. This separation stops at the inner end or hook 16, but proceeds around the periphery of the tear panel to outer end or hook 17 (see FIG. 1). The tear panel 12 is effectively folded into the can through the opening defined by tear panel score line 15.

Figure 2:
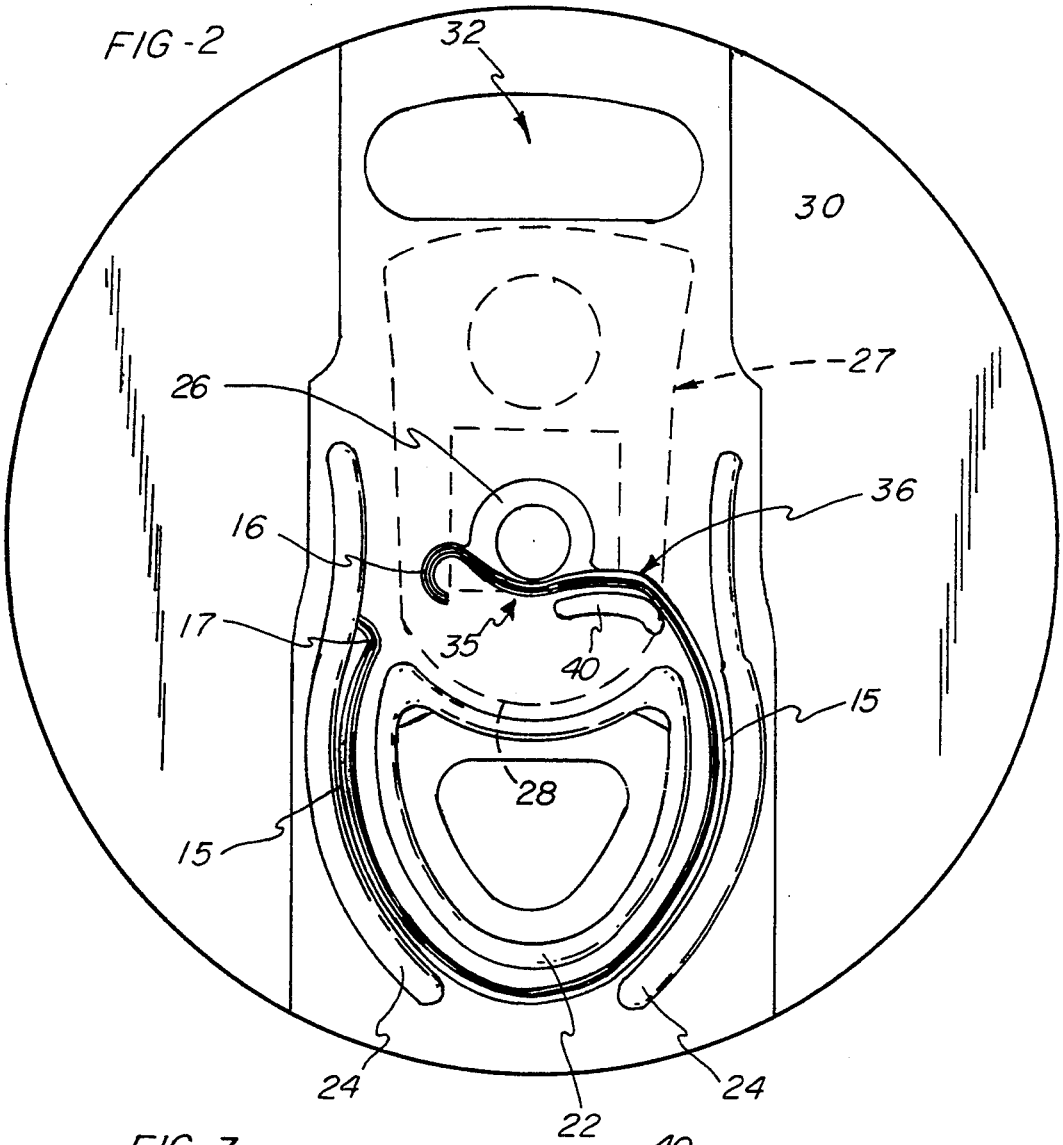
FIG. 2 is a bottom or product side plan view of an easy open container end as shown in FIG. 1.
Figure 3:
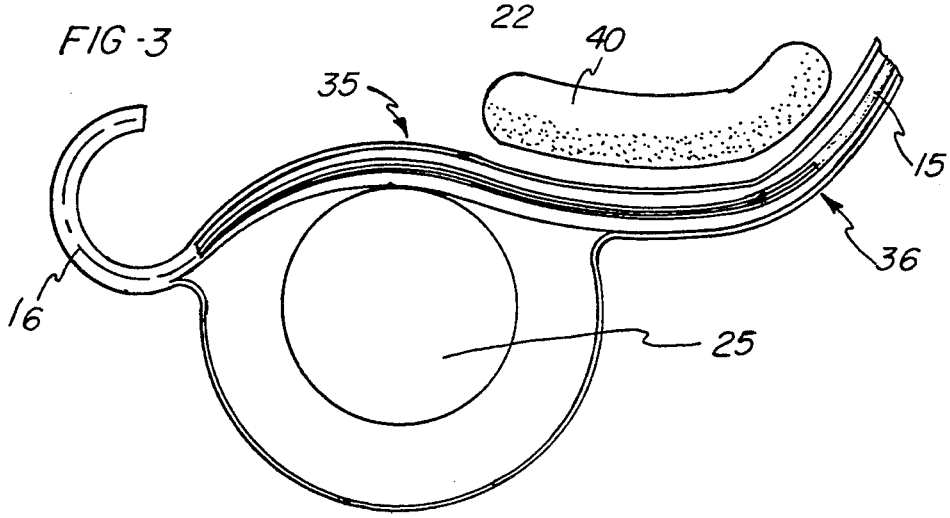
FIG. 3 is an enlarged bottom view of the venting region adjacent the inner end of the tear panel score line and the rivet.
Figure 4:
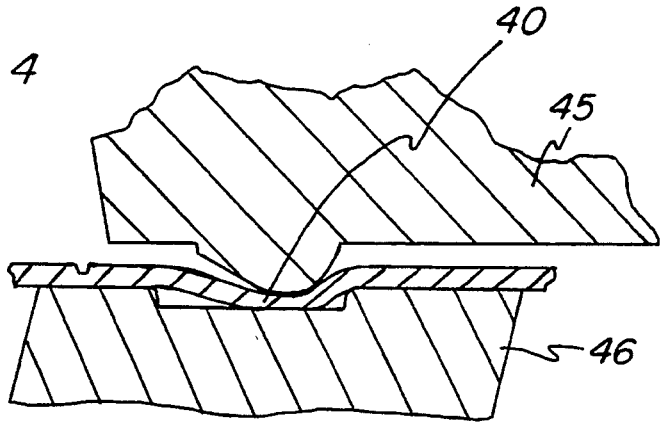
FIG. 4 is an enlarged view of portions of a coining punch and die which form the coined region in the tear panel adjacent the rivet, on the opposite side of the rivet from the score line inner end hook.

Returning to the venting function, according to the invention an arrestor or score stop is either not employed, or is made with considerably less thickness than normal, while still leaving adequate residual metal along score line 15 with the use of thinner end metal, e.g. 0.009–0.008 inch thick. In addition, a coined vent bead 40 is formed in tear panel 12, generally parallel to score line 15, at and inward from the curve 36 in the score line, as seen in FIGS. 1 and 2. Preferably, the vent bead is formed on the public side of the tear panel. FIG. 3 shows, in enlarged detail, the shape of the vent bead 40, and FIG. 4 shows (also enlarged) a cross-section of the portion of a punch 45 and die 46 (not fully closed) which produce the vent bead.

This configuration is conveniently added to the punch and die at the first form station in a set of end conversion tools. The location of the first form station in a typical progression is shown in FIG. 20 of U.S. Pat. No. 5,119,664, specifically at FIG. 20D.

Figure 5:
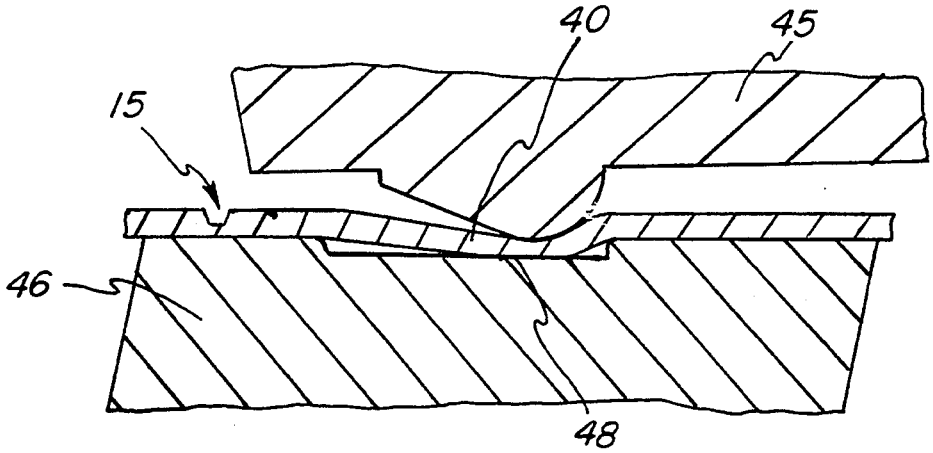
FIG. 5 is an enlargement of the center portion of FIG. 4, showing the coined region of the vent bead and its relationship to the adjacent tear panel score line.
Figure 6:
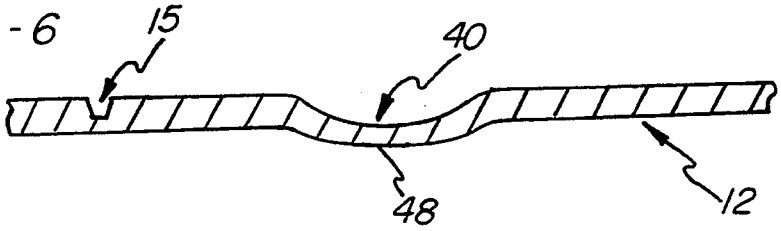
FIG. 6 is an enlarged segmental cross-section of the region of the coined vent bead and adjacent score line, prior to venting.

It is emphasized that the vent bead is coined, as at 48 in FIG. 5, not merely formed by displacing the metal, so the coining action compresses and moves the metal along the vent bead close to score line 15. This coined bead creates compression in the metal of the tear panel 12, just inward of score line 15, along the portion of the score line generally parallel to vent bead 40. When tab 27 is initially raised and the venting or "pop" occurs, this region of tear panel 12 will remain below the lifting or rising edge of the end material around the rivet island 26 and along vent region 35, since the initial tab movement pulls up on rivet 25 while pressing against tear panel 12.

Figure 7:
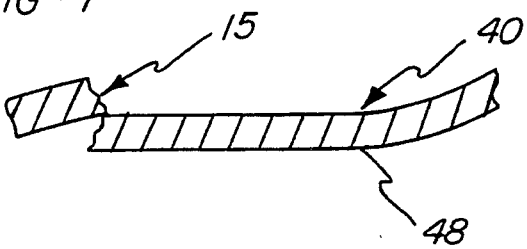
FIG. 7 is a view similar to FIG. 6 showing the score line ruptured in the vent region.

It has been observed that the edge of tear panel 12, particularly adjacent the coined vent bead, effectively will move under the edge of the metal on the other side of the just ruptured score line 15 (see FIG. 7). It appears that the compression of the metal in the coined vent bead is somewhat released at this time, and causes this overlapping of the metal remaining along the ruptured score line with the adjacent freed edge of tear panel 12. High pressure from within the can will tend to act in the same opening direction of this vent region by contributing to the raising of the rivet island, but the same pressure exerted against the tear panel will only tend to urge the edge of the tear panel vent area toward the underside of the raised vent island and adjacent metal of the end, and "blow-off" of the tear panel will be avoided. Furthermore, this action interferes with progression of separation along score line 15, and limits the length of the vent region along the score line to approximately the same length as occurs in an end of thicker metal where an arrestor or score stop is added to the tear panel score line.

Figure 8:
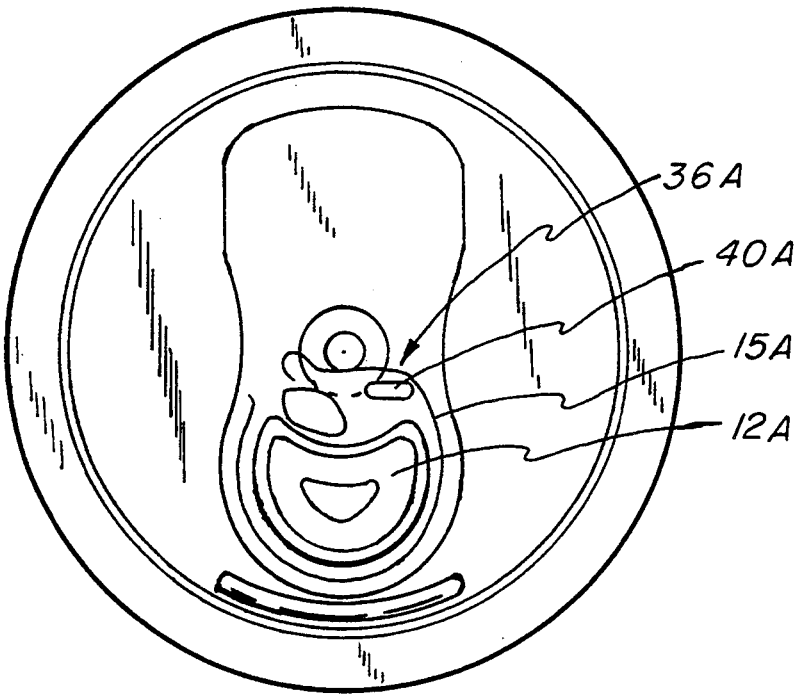
FIG. 8 is a view similar to FIG. 2, showing a modified form of the coined vent bead adjacent to the venting region of the tear panel score line.

FIG. 8 shows a modified form of coined vent bead, which has an over-all appearance similar to the previous "dimple-down" configuration mentioned in the Background discussion. Similar reference numerals with the suffix "A" are used. Here the coined vent bead 40A is of straight configuration, and is not contoured to the closely adjacent tear panel score line 15A. Instead, the coined vent bead 40A extends generally parallel to the score line 15A, and one end of the vent bead is located closely adjacent to the curve 36A in score line 15A where it is desired to define the other end of the vent region, opposite from the inner hook 16A.

Figure 9:
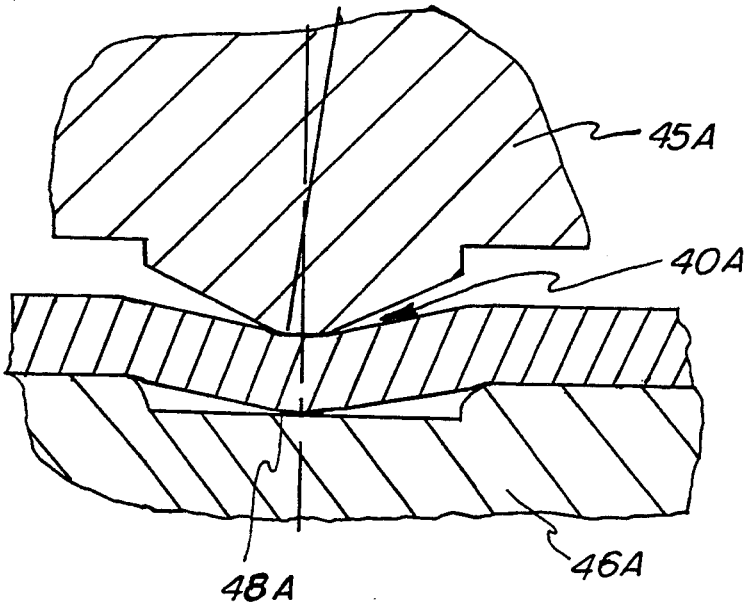
FIG. 9 is an enlarged view showing the formation and coining of the modified embodiment of FIG. 8.

FIG. 9 shows the portion of a punch 45A and die 46A which forms and coins this modified vent bead, and the coined area of this bead is indicated at 48A. It is also possible to use a simple flat anvil surface, in place of the cavity in die 46A, to cooperate with punch 45A and achieve the desired result.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. In an easy-open end for a container, said end having a tear panel defined by a score line surrounding a portion of the periphery of said tear panel, said score line defining a region where said tear panel is to be separated from the remainder of the end to form an opening through said end, an operating tab, and an integral rivet attaching said tab to said end adjacent said score line and on the opposite side of said score line from said tear panel, said score line including a vent region adjacent of said rivet constructed and arranged to open initially at said vent region in response to lifting of said rivet by said tab; the improvement comprising a vent bead formed in said tear panel to one side of said rivet and adjacent an edge of said vent region of said score line and having a length extending along at least a part of, but not substantially beyond, said vent region, said vent bead being coined along its length thereby creating compression in the metal of said vent bead adjacent said vent region of said score line which, upon fracturing of said vent region, will cause an edge of said tear panel to move temporarily underneath the end on the opposite side of the fractured score line.

2. An easy-open end as defined in claim 1, wherein said vent bead is contoured to the shape of said score line at said vent region to provide a coined region of compressed metal along a substantial extent of said score line.

3. An easy-open end as defined in claim 1, wherein said vent bead is substantially linear and one end thereof is located closely adjacent said vent region of said score line.

4. An easy-open end for a container, said end having a public side and a product side and having a tear panel defined by a score line surrounding the portion of the periphery of said panel to be separated from the remainder of the end to form an opening in the end, an operating tab, an integral rivet attaching said tab to said end adjacent said score line and on the opposite side of said score line from said tear panel, said score line including a vent region adjacent said rivet constructed and arranged to open initially at said vent region in response to lifting of said rivet by said tab, an elongated vent bead formed in the public side of said tear panel to one side of said rivet and having a length adjacent an edge of said vent region of said score line not substantially greater in length than said vent region, said vent bead being coined along its length creating compression in the metal of said vent bead adjacent said vent region, whereby upon initial rupture of said score line during venting a portion of said tear panel along said vent region is caused to locate beneath the product side of the metal of the end on the opposite side of the ruptured score line before the score line is fully ruptured and said tear panel is opened.

5. In an easy-open end for a container adapted to contain pressurized contents, said end having a tear panel defined by a score line surrounding the portion of the periphery of said panel to be separated from the remainder of the end to form an egress opening therein, an operating tab, and an integral rivet attaching said tab to said end adjacent said score line and on the opposite side of said score line from said tear panel, said score line including a vent region adjacent said rivet constructed and arranged to rupture and open initially at said vent region in response to lifting of said rivet by said tab;

the method of defining the length of the vent region comprising forming an elongated vent bead in the tear panel to one side of the rivet and along an edge of the vent region of the score line and thereby creating compression in the metal of the vent bead adjacent and along said vent region of the score line, said vent bead being not substantially greater in length than said vent region.

6. The easy-open end as defined in claim 5, further comprising upon initial separation of the score line along the vent region, causing a portion of an edge of the tear panel to locate under the metal of the end on the opposite side of the vent region from the tear panel.

* * * * *